US012594644B2

(12) United States Patent
Albrecht et al.

(10) Patent No.: US 12,594,644 B2
(45) Date of Patent: Apr. 7, 2026

(54) POLISHING HEAD ASSEMBLY HAVING RECESS AND CAP

(71) Applicant: GlobalWafers Co., Ltd., Hsinchu (TW)

(72) Inventors: Peter Daniel Albrecht, O'Fallon, MO (US); Chih Yuan Hsu, Hsinchu (TW); Jen Chieh Lin, Hsinchu (TW); Wei Chang Huang, Hsinchu County (TW); Yau-Ching Yang, Hsinchu County (TW)

(73) Assignee: GlobalWafers Co., Ltd., Hsinchu (TW)

( * ) Notice: Subject to any disclaimer, the term of this patent is extended or adjusted under 35 U.S.C. 154(b) by 516 days.

(21) Appl. No.: 17/806,378

(22) Filed: Jun. 10, 2022

(65) Prior Publication Data

US 2022/0410340 A1 Dec. 29, 2022

Related U.S. Application Data

(60) Provisional application No. 63/202,827, filed on Jun. 25, 2021.

(51) Int. Cl.
*B24B 37/26* (2012.01)

(52) U.S. Cl.
CPC ..... *B24B 37/26* (2013.01)

(58) Field of Classification Search
None
See application file for complete search history.

(56) References Cited

U.S. PATENT DOCUMENTS 5,664,989 A 9/1997 Nakata et al.
5,964,653 A 10/1999 Perlov et al.
6,019,670 A * 2/2000 Cheng ..... B24B 37/32 451/286
6,056,632 A 5/2000 Mitchel et al.
(Continued)

FOREIGN PATENT DOCUMENTS

CN 107511721 A 12/2017
CN 111251177 A 6/2020
(Continued)

OTHER PUBLICATIONS

International Search Report and Written Opinion regarding International Application Serial No. PCT/US2015/054033, dated Apr. 11, 2016; 15 pages.
(Continued)

*Primary Examiner* — Brian D Keller
*Assistant Examiner* — Jason Khalil Hawkins
(74) *Attorney, Agent, or Firm* — Armstrong Teasdale LLP

(57) ABSTRACT

A polishing head assembly for polishing of semiconductor wafers includes a polishing head and a cap. The polishing head has a top portion and a recess along a bottom portion. The recess has a recessed surface. Holes extend from the top portion through the recessed surface. The cap is positioned within the recess and the cap has an annular wall and a floor extending across the annular wall. The annular wall has apertures corresponding to the holes. The floor is spaced from the recessed surface to form a chamber therebetween. The polishing head assembly also includes a band that circumscribes a portion of the annular wall. The holes and the corresponding apertures receive fasteners to removably secure the annular wall to the recessed surface.

17 Claims, 6 Drawing Sheets

(56) References Cited

U.S. PATENT DOCUMENTS

| | | | | |
|---|---|---|---|---|
| 6,116,992 | A * | 9/2000 | Prince | B24B 37/30 451/286 |
| 6,159,079 | A * | 12/2000 | Zuniga | B24B 37/30 451/286 |
| 6,162,116 | A | 12/2000 | Zuniga et al. | |
| 6,165,056 | A | 12/2000 | Hayashi et al. | |
| 6,273,803 | B1 | 8/2001 | Wang et al. | |
| 6,592,434 | B1 * | 7/2003 | Vanell | B24B 37/30 451/41 |
| 6,623,343 | B2 | 9/2003 | Kajiwara et al. | |
| 6,666,756 | B1 * | 12/2003 | Travis | B24B 37/32 451/283 |
| 6,722,965 | B2 | 4/2004 | Zuniga et al. | |
| 6,746,313 | B1 * | 6/2004 | Pham | B24B 37/32 451/286 |
| 6,755,723 | B1 | 6/2004 | Pham | |
| 6,893,327 | B2 | 5/2005 | Kajiwara et al. | |
| 8,088,299 | B2 | 1/2012 | Chen et al. | |
| 8,092,281 | B2 | 1/2012 | Masumara et al. | |
| 9,566,687 | B2 | 2/2017 | Albrecht et al. | |
| 10,857,649 | B2 | 12/2020 | Lee et al. | |
| 2002/0039879 | A1 * | 4/2002 | Zuniga | B24B 37/30 451/288 |
| 2002/0081955 | A1 * | 6/2002 | Numoto | B24B 49/16 451/288 |
| 2003/0124963 | A1 | 7/2003 | Zuniga et al. | |
| 2006/0128286 | A1 * | 6/2006 | Nabeya | B24B 49/16 451/287 |
| 2006/0160474 | A1 | 7/2006 | Tseng et al. | |
| 2007/0207709 | A1 | 9/2007 | Berkstresser et al. | |
| 2008/0188167 | A1 | 8/2008 | Ishii et al. | |
| 2010/0210192 | A1 | 8/2010 | Masumara et al. | |
| 2010/0273405 | A1 * | 10/2010 | Fukushima | B24B 37/30 451/449 |
| 2015/0360343 | A1 * | 12/2015 | Yavelberg | B24B 37/32 438/5 |
| 2016/0016282 | A1 * | 1/2016 | Chen | B24B 37/30 451/526 |
| 2016/0121453 | A1 * | 5/2016 | Ishikawa | B24B 37/105 451/385 |

FOREIGN PATENT DOCUMENTS

| | | | |
|---|---|---|---|
| JP | 2000202762 | A | 7/2000 |
| JP | 6491812 | B2 | 3/2019 |
| JP | 6657201 | B2 | 3/2020 |

OTHER PUBLICATIONS

International Search Report and Written Opinion issued for PCT/US2022/034175 dated Oct. 4, 2022.

* cited by examiner

POLISHING HEAD ASSEMBLY HAVING RECESS AND CAP

CROSS-REFERENCE TO RELATED APPLICATION

This application claims priority to U.S. Provisional Patent Application No. 63/202,827 filed on Jun. 25, 2021, the disclosure of which is hereby incorporated by reference in its entirety.

FIELD

This disclosure relates generally to polishing of semiconductor wafers and more particularly to a polishing head assembly having a recess and cap.

BACKGROUND

Semiconductor wafers are commonly used in the production of integrated circuit (IC) chips on which circuitry are printed. The circuitry is first printed in miniaturized form onto surfaces of the wafers. The wafers are then broken into circuit chips. This miniaturized circuitry requires that front and back surfaces of each wafer be extremely flat and parallel to ensure that the circuitry can be properly printed over the entire surface of the wafer.

To accomplish this, grinding and polishing processes are commonly used to improve flatness and parallelism of the front and back surfaces of the wafer after the wafer is cut from an ingot. A particularly good finish is required when polishing the wafer in preparation for printing the miniaturized circuits on the wafer by an electron beam-lithographic or photolithographic process (hereinafter "lithography"). The wafer surface on which the miniaturized circuits are to be printed must be flat.

Polishing machines typically include a circular or annular polishing pad mounted on a turntable or platen for driven rotation about a vertical axis passing through the center of the pad and a mechanism for holding the wafer and forcing it into the polishing pad. The wafer is typically mounted to the polishing head using for example, liquid surface tension or vacuum/suction. A polishing slurry, typically including chemical polishing agents and abrasive particles, is applied to the pad for greater polishing interaction between the polishing pad and the surface of the wafer. This type of polishing operation is typically referred to as chemical-mechanical polishing (CMP).

During operation, the pad is rotated and the wafer is brought into contact with and forced against the pad by the polishing head. The polishing head is typically assembled using epoxy glue. However, failure of the epoxy glue joints during the service life of the polishing head may cause undesirable effects, including loosening of parts, air leaks, wafer damage, and poor yield. Repair of these polishing heads is difficult because the head must be heated to release the remaining epoxy to allow complete disassembly of the head. After heat removal, few existing parts of the head assembly can be salvaged. Accordingly, there is a need for an improved polishing head assembly.

This Background section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

SUMMARY

In one aspect, a polishing head assembly for polishing of semiconductor wafers includes a polishing head and a cap. The polishing head has a top portion and a recess along a bottom portion. The recess has a recessed surface. Holes extend from the top portion through the recessed surface. The cap is positioned within the recess and the cap has an annular wall and a floor extending across the annular wall. The cap is made of a structural material. The floor has a bottom surface and a top surface, and the floor is spaced from the recessed surface to form a chamber between the recessed surface and the top surface. The annular wall has apertures corresponding to the holes. The polishing head assembly also includes a band that circumscribes a portion of the annular wall. The holes and the corresponding apertures receive fasteners to removably secure the annular wall to the recessed surface.

In another aspect, a polishing head assembly for polishing of semiconductor wafers includes a polishing head and a cap. The polishing head has a top portion and a downwardly extending annular member defining a recess along a bottom portion. The recess has a recessed surface. Holes extend from the top portion through the recessed surface. The cap is positioned within the recess and the cap has an annular wall and a floor extending across the annular wall. The cap is made of a structural material. The floor is spaced from the recessed surface to form a chamber therebetween. The annular wall has a first portion and a second portion. The first portion of the annular wall has apertures corresponding to the holes. The second portion of the annular wall extends downward from the first portion. The polishing head assembly also includes a unitary one-piece band circumscribing the second portion of the annular wall. The holes and the corresponding apertures receive fasteners to removably secure the first portion of the annular wall of the cap to the recessed surface of the polishing head. The first portion of the annular wall has a first o-ring forming a seal when the first portion and the recessed surface are secured.

Various refinements exist of the features noted in relation to the above-mentioned aspects. Further features may also be incorporated in the above-mentioned aspects as well. These refinements and additional features may exist individually or in any combination. For instance, various features discussed below in relation to any of the illustrated embodiments may be incorporated into any of the above-described aspects, alone or in any combination.

BRIEF DESCRIPTION OF THE DRAWINGS

Like reference symbols in the various drawings indicate like elements.

DETAILED DESCRIPTION

Figure 1:
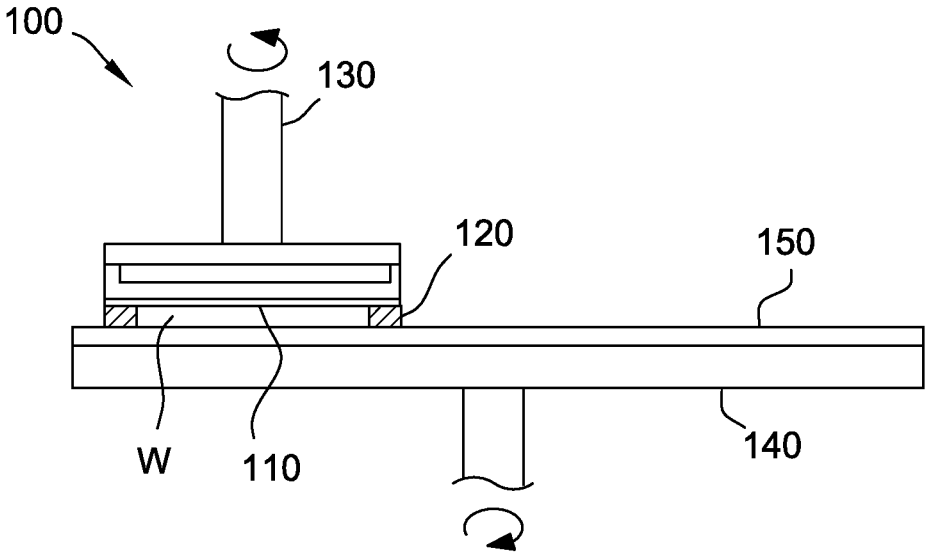
FIG. 1 is a partially schematic elevation of a polishing apparatus.

Generally, and in embodiments of the present disclosure, suitable substrate "wafers" (which may also be referred to as "semiconductor wafers" or "silicon wafers") include single crystal silicon wafers, such as, for example, silicon wafers obtained by slicing the wafers from single crystal silicon ingots formed by the Czochralski method or the float zone method. Each wafer includes a central axis, a front surface, and a back surface parallel to the front surface. The front and back surfaces are generally perpendicular to the central axis. A circumferential edge joins the front and back surfaces. The wafers may be any diameter suitable for use by those of skill in the art including, for example, 200 millimeter (mm), 300 mm, greater than 300 mm or even 450 mm diameter wafers.

In one embodiment, a wafer that has previously been rough polished so that it has rough front and back surfaces is first subjected to an intermediate polishing operation in which the front surface of the wafer, but not the back surface, is polished to improve flatness parameters or to smooth the front surface and remove handling scratches. To carry out this operation, the wafer is placed against the polishing head assembly. In this embodiment, the wafer is retained in position against the polishing head assembly by surface tension. The wafer also is placed on a turntable of a polishing machine with the front surface of the wafer contacting the polishing surface of a polishing pad.

A polishing head assembly mounted on the machine is capable of vertical movement along an axis extending through the wafer. While the turntable rotates, the polishing head assembly is moved against the wafer to urge the wafer toward the turntable, thereby pressing the front surface of the wafer into polishing engagement with the polishing surface of the polishing pad.

A conventional polishing slurry containing abrasive particles and a chemical etchant is applied to the polishing pad. The polishing pad works the slurry against the surface of the wafer to remove material from the front surface of the wafer, resulting in a surface of improved smoothness. As an example, the intermediate polishing operation preferably removes less than about 1 micron of material from the front side of the wafer.

The wafer is then subjected to a finish polishing operation in which the front surface of the wafer is finish polished to remove fine or "micro" scratches caused by large size colloidal silica, such as Syton® from DuPont Air Products Nanomaterials, LLC, in the intermediate step and to produce a highly reflective, damage-free front surface of the wafer. The intermediate polishing operation generally removes more of the wafer than the finishing polishing operation. The wafer may be finish polished in the same polishing machine used to intermediate polish the wafer as described above. However, a separate polishing machine may also be used for the finish polishing operation. A finish polishing slurry typically has an ammonia base and a reduced concentration of colloidal silica is injected between the polishing pad and the wafer. The polishing pad works the finish polishing slurry against the front surface of the wafer to remove any remaining scratches and haze so that the front surface of the wafer is generally highly-reflective and damage free.

Referring to FIG. 1, a portion of a polishing apparatus is shown schematically and indicated generally at 100. The polishing apparatus 100 may be used to polish a front surface of semiconductor wafers W. It is contemplated that other types of polishing apparatus may be used.

The polishing apparatus 100 includes a wafer holding mechanism, e.g., a template comprising a backing film 110 and a retaining ring 120, a polishing head assembly 130, and a turntable 140 having a polishing pad 150. The backing film 110 is located between a polishing head assembly 130 and the retaining ring 120, which receives a wafer W. The retaining ring 120 has at least one circular opening to receive the wafer W to be polished therein.

The wafer W in this embodiment is attached to and retained against the polishing head assembly 130 by surface tension. To form the surface tension, the wet saturated backing film 110 is attached to the polishing head assembly 130 with a pressure sensitive adhesive. The backing film 110 and retaining ring 120 form a template or "wafer holding template." The backing film 110 is generally a soft polymer pad or other suitable material.

The wafer W is then pressed into the wet saturated backing film 110 to remove or squeeze out the majority of the water or other suitable liquid. Squeezing out the water causes the wafer to be retained on the backing film 110 by surface tension and the atmospheric pressure on the exposed surface of the wafer. This squeezing out of the water mounts the wafer to the polishing head assembly 130.

A portion of the polishing head assembly 130 is flexible enough to deform in response to a change in pressure applied to the polishing head assembly 130, and stiff enough not to deform when the wafer is pressed into the wet saturated template. The surface tension provides a constant retaining force over the surface of the wafer. This constant retaining force causes any deformation of the polishing head assembly 130 adjacent to the wafer to be directly translated into proportional deformation of the wafer.

The retention of the wafer W by surface tension functions differently than other known mechanisms that use flexible membranes or vacuums to retain the wafer against the polishing head assemblies. Flexible membranes, as known in the art, deform to create space or vacuum pockets between the wafer and the flexible membrane when the wafer is pushed thereon. These vacuum pockets allow the membrane to pick up the wafer. Other membranes have vacuum holes, which are connected to a vacuum to create low pressure areas to pick up wafers.

The polishing apparatus 100 applies a force to the polishing head assembly 130 to move the polishing head assembly 130 vertically to raise and lower the polishing head assembly 130 with respect to the wafer W and the turntable 140. An upward force raises the polishing head assembly 130, and a downward force lowers the polishing head assembly. As discussed above, the downward vertical movement of the polishing head assembly 130 against the wafer W provides the polishing pressure to the wafer to urge the wafer into the polishing pad 150 of the turntable 140. As the polishing apparatus 100 increases the downward force, the polishing head assembly 130 moves vertically lower to increase the polishing pressure.

A portion of the polishing head assembly 130 and polishing pad 150 and turntable 140 are rotated at selected rotation speeds by a suitable drive mechanism (not shown) as is known in the art. The rotational speeds of the polishing pad and the turntable may be the same or different. In some embodiments, the polishing apparatus 100 includes a controller (not shown) that allows the operator to select rotation speeds for both the polishing head assembly 130 and the turntable 140, and the downward force applied to the polishing head assembly.

Figure 2:
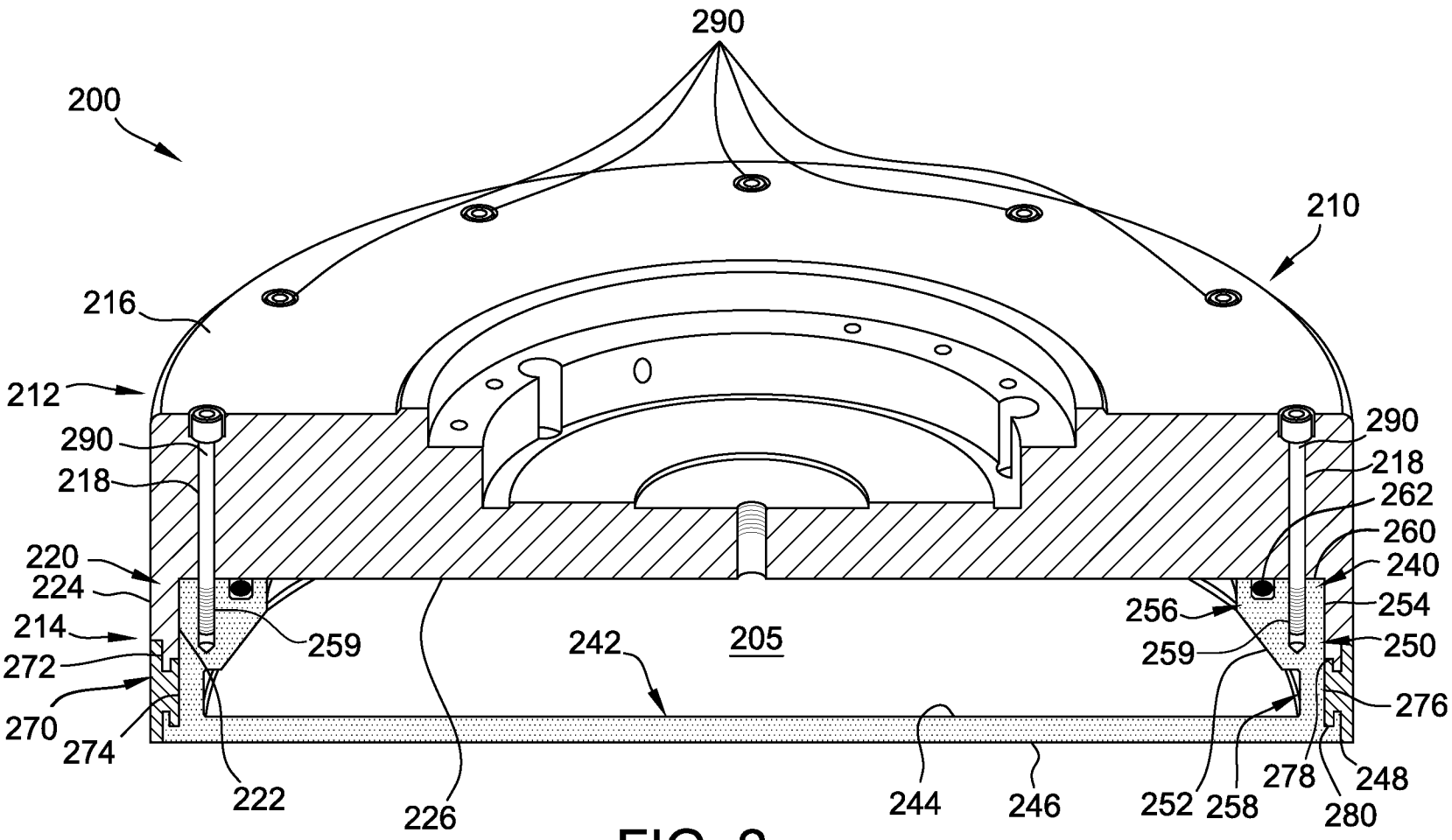
FIG. 2 is a cross section of an example polishing head assembly of a first embodiment.

With reference to FIG. 2, an example polishing head assembly 200 for use in the polishing apparatus 100 is shown. The polishing head assembly 200 includes a polishing head 210, a cap 240, and a band 270. The polishing head assembly 200 may also include a template comprising a backing film and retaining ring, for example, the backing film 110 and the retaining ring 120 (shown in FIG. 1). The polishing head 210 has a top 212 and a bottom 214 that are substantially parallel with each other. The polishing head 210 has a platform 216 at the top 212 and holes 218 extending from the platform 216 through the bottom 214.

The polishing head 210 has an annular member 220 extending downward from the platform 216 to the bottom 214. The annular member 220 has an inner surface 222 and an outer surface 224. The outer surface 224 forms the circumference of the polishing head 210. The annular member 220 defines a recess along the bottom 214, and the recess has a recessed surface 226 extending between the annular member 220. The holes 218 extend from the platform 216 through the recessed surface 226 in this embodiment. As discussed in more detail below, a portion of the annular member 220 at the bottom 214 may have inlets 272, 278 formed on the outer surface 224 and the inner surface 222, respectively, that mate with the shape of band 270.

The cap 240 is positioned within the recess defined by the annular member 220. The cap 240 includes a floor 242 surrounded by an annular wall 250 extending upward therefrom. The floor 242 has a top surface 244 and a bottom surface 246. In this embodiment, the bottom surface 246 extends outward past the annular wall 250 to a tab 248. As discussed in more detail below, the tab 248 may be shaped to mate with the band 270. In other embodiments, the bottom surface 246 may not extend past the annular wall 250, such that the annular wall 250 defines the outermost circumference of the cap 240.

The annular wall 250 has an inside surface 252, an outside surface 254, a top portion 256 and a bottom portion 258. The top portion 256 has a top edge 260 and apertures 259 formed at the top edge 260. The apertures 259 extend into the top portion 256 and correspond to the holes 218. The holes 218 and the corresponding apertures 259 receive fasteners 290 (e.g., screws) to removably secure the annular wall 250 to the recessed surface 226, and thereby removably secure the cap 240 to the polishing head 210. The top edge 260 of the annular wall 250 contacts the recessed surface 226 when the annular wall 250 is secured to the recessed surface 226. The top portion 256 may also include an o-ring 262 at the top edge 260 which forms a seal when the annular wall 250 is secured to the recessed surface 226.

As shown in FIG. 2, the thickness of the annular wall 250 is greater at the top portion 256 than the bottom portion 258. The thinner wall of the bottom portion 258 allows the bottom portion 258 to act as a hinge about which the floor 242 may temporarily deflect without permanently deforming relative to the polishing head 210. For example, the floor 242 may temporarily deflect upward toward the polishing head 210 in response to downward vertical movement of the polishing head assembly 200 causing the cap 240 to contact a wafer (such as wafer W shown in FIG. 1). The inside surface 252 of the annular wall 250 at the top portion 256 may be angled with respect to the outside surface 254, such that the thickness of the top portion 256 is thickest at the top edge 260 and tapers downward toward the bottom portion 258.

At least a portion of the outside surface 254 abuts the inner surface 222 of the annular member 220 when the cap 240 is secured to the polishing head 210. Suitably, the outside surface 254 is substantially parallel to the inner surface 222. In this embodiment, the height of the annular wall 250 is greater than the downward extension of the annular member 220 and the inner surface 222 of the annular member 220 circumscribes the top portion 256 of the annular wall 250. In other embodiments, the annular member 220 may circumscribe more or less of the annular wall 250.

The floor 242 is spaced from the recessed surface 226 when the cap 240 is secured to the polishing head 210. As such, the annular wall 250, the top surface 244 of the floor 242, and the recessed surface 226 define a chamber 205 when the cap 240 is secured to the polishing head 210. Because the top edge 260 contacts the recessed surface 226 when the annular wall 250 is secured to the recessed surface 226, the height of the chamber 205 is determined by the height of the annular wall 250. In some embodiments, the chamber 205 is pressurized with a pressurized media or fluid. The chamber 205 may be connected with a pressurized source (not shown) to provide a pressurized media or fluid to the chamber 205. As discussed above, the floor 242 may be capable of temporarily deflecting relative to the polishing head 210 without permanently deforming. For example, adjusting pressure in the chamber 205 may cause deflection of the floor 242 to increase or decrease. In embodiments where the o-ring 262 is used, the seal formed between the top edge 260 and the recessed surface 226 by the o-ring 262 may prevent leakage of the pressurized media or fluid from chamber 205, thereby maintaining a given pressure in the chamber 205.

The polishing head 210 and the cap 240 may be made of a structural material, such as steel, aluminum, ceramic or another suitable material. In some embodiments, the polishing head 210 and the cap 240 are made of cast aluminum (for example, MIC6® Aluminum Cast Plate available from Alcoa.) In other embodiments, the cap 240 may be made of a ceramic, such as alumina, or plastic material. In embodiments that use a plastic material, a polyetherimide (for example, ULTEM™ Resin 1000 available from Saudi Basic Industries Corporation (SABIC)) may be used. A plastic cap 240 is substantially thicker than one made with either metal or ceramic. Caps made with a ceramic material have substantially thinner floors than those made with either metal or plastic.

Metal used in the polishing head assembly 200 has the potential to contaminate a wafer by being a source of metal ions through the polishing chemicals or slurry. To prevent metal from the polishing head 210 from contaminating the slurry and the wafer, the polishing head 210 is coated with epoxy, fluorocarbon, or another suitable, non-metallic material, to create a barrier to provide metal ion protection.

To prevent metal used in the polishing head assembly 200 from contaminating the slurry and wafer, and/or to prevent chemical exposure of the metal from the polishing chemicals or slurry, a portion of the polishing head 210 and/or the cap 240 is circumscribed by the band 270. The band 270 forms a barrier between the slurry and the polishing head 210 and/or the cap 240. The band 270 may be a non-metallic material. In some embodiments, the band 270 is made of plastic, such as polyetherimide (for example, ULTEM™ Resin 1000 available from Saudi Basic Industries Corporation (SABIC)), polyether ether ketone, polyphenylene sulfide, or polyethylene terephthalate.

In this embodiment, the band 270 circumscribes and may be sealed to a portion of the polishing head 210 at the bottom 214, the portion of the outer surface 254 of the annular wall 250 not circumscribed by the polishing head 210, and the tab 248. The annular member 220 has a side inlet 272 that extends inward from the outer surface 224 at the bottom 214 of the polishing head 210. A side recess 274 is formed between tab 248 and the bottom of annular member 220 and extends along the portion of the outside surface 254 of the annular wall 250 not circumscribed by the annular member 220. The band 270 is sized and shaped to circumscribe the side inlet 272, the side recess 274 and the tab 248 and form a seal therebetween.

In some embodiments, the band 270 is non-unitary and is made of two or more segments. For example, the band 270 may be made of three, four, five, or six segments. In these embodiments, the band 270 may be sealed together at the segment joints (e.g., segment joints 275 shown in FIG. 5) and sealed to the polishing head 210 and/or the cap 240 using an adhesive, such as epoxy glue. To prevent the seal between the band 270 and the polishing head 210 and/or the cap 240 from coming loose due to adhesive failure, the band 270 may include an interlocking member 276 to secure the band 270 to the polishing head assembly 200. For example, the band 270 may include a dovetail 276 which forms a joint with an inner inlet 278 formed on the inner surface 222 of the annular member 220 and with an inner recess 280 formed by an upward extending member of the tab 248. The dovetail 276 may be used to secure the band 270 to the polishing head 210 and/or the cap 240 in addition to an adhesive or as an alternative.

In embodiments where the polishing head assembly 200 includes a template comprising a backing film and retaining ring, such as the backing film 110 and the retaining ring 120 shown in FIG. 1, the band 270 may also overlap at least a portion of the template to prevent metal contamination of the slurry or wafer from the polishing head 210 and/or the cap 240, and/or to prevent chemical exposure of the metal from the polishing chemicals or slurry.

Figure 3:
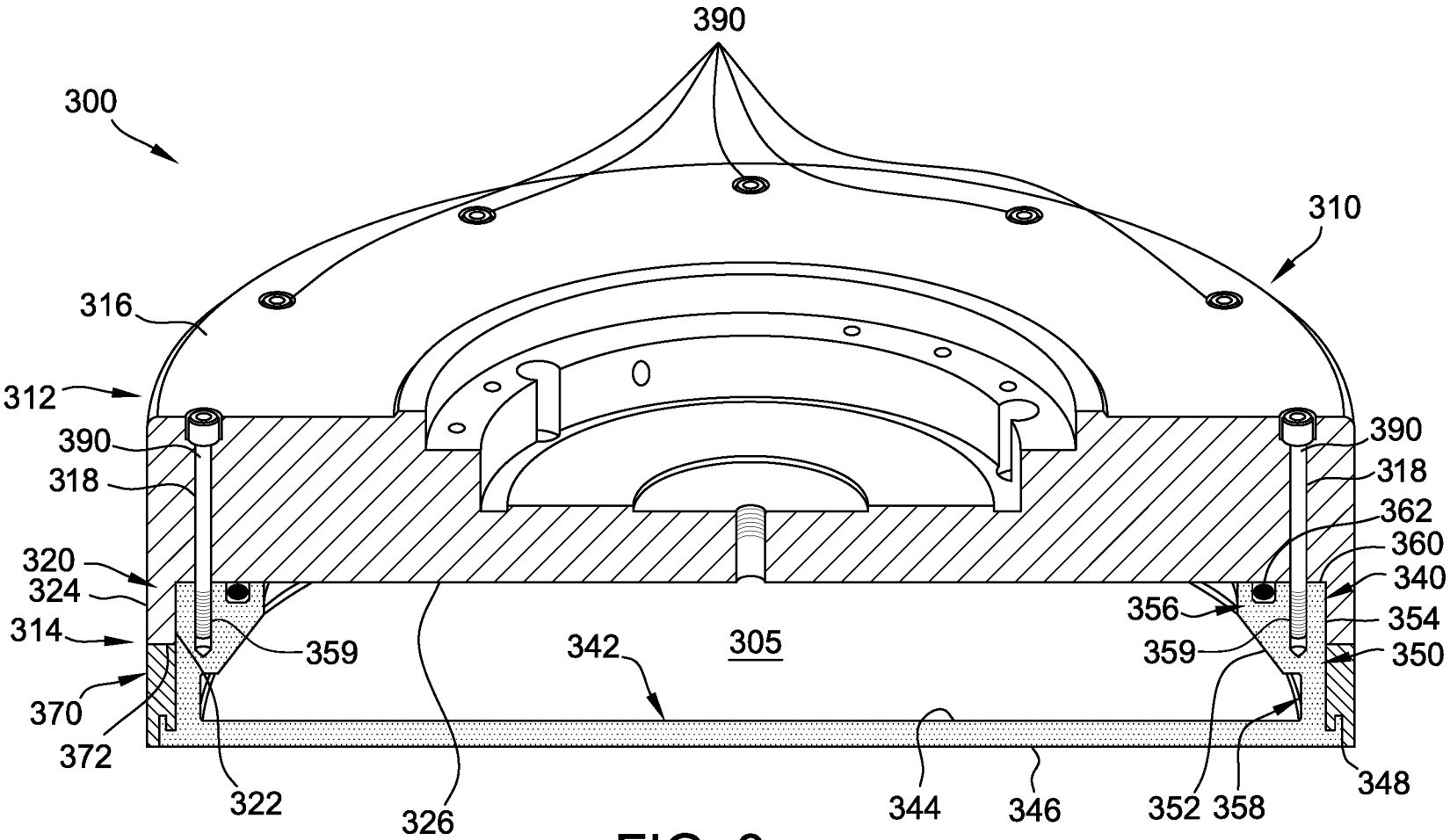
FIG. 3 is a cross section of an example polishing head assembly of a second embodiment.

With reference to FIG. 3, another example polishing head assembly 300 for use in the polishing apparatus 100 is shown. The polishing head assembly 300 includes a polishing head 310, a cap 340, and a band 370. The polishing head assembly 300 may also include a template comprising a backing film and retaining ring, for example, the backing film 110 and the retaining ring 120 (shown in FIG. 1). The polishing head 310 has a top 312 and a bottom 314 that are substantially parallel with each other. The polishing head 310 has a platform 316 at the top 312 and holes 318 extending from the platform 316 through the bottom 314.

The polishing head 310 has an annular member 320 extending downward from the platform 316 to the bottom 314. The annular member 320 has an inner surface 322 and an outer surface 324. The outer surface 324 forms the circumference of the polishing head 310. The annular member 320 defines a recess along the bottom 314, and the recess has a recessed surface 326 extending between the annular member 320. The holes 318 extend from the platform 316 through the recessed surface 326 in this embodiment. The annular member 320 has a bottom edge 372 at the bottom 314 which is overlapped by, and may be sealed to, the band 370.

The cap 340 is positioned within the recess defined by the annular member 320. The cap 340 includes a floor 342 surrounded by an annular wall 350 extending upward therefrom. The floor 342 has a top surface 344 and a bottom surface 346. In this embodiment, the bottom surface 346 extends outward past the annular wall 350 to a tab 348. In other embodiments, the bottom surface 346 may not extend past the annular wall 350, such that the annular wall 350 defines the outermost circumference of the cap 340.

The annular wall 350 has an inside surface 352, an outside surface 354, a top portion 356 and a bottom portion 358. The top portion 356 has a top edge 360 and apertures 359 formed at the top edge 360. The apertures 359 extend into the top portion 356 and correspond to the holes 318. The holes 318 and the corresponding apertures 359 receive fasteners 390 (e.g., screws) to removably secure the annular wall 350 to the recessed surface 326, and thereby removably secure the cap 340 to the polishing head 310. The top edge 360 of the annular wall 350 contacts the recessed surface 326 when the annular wall 350 is secured to the recessed surface 326. The top portion 356 may also include an o-ring 362 at the top edge 360 which forms a seal when the annular wall 350 is secured to the recessed surface 326.

As shown in FIG. 3, the thickness of the annular wall 350 is greater at the top portion 356 than the bottom portion 358. The thinner wall of the bottom portion 358 allows the bottom portion 358 to act as a hinge about which the floor 342 may temporarily deflect without permanently deforming relative to the polishing head 310. For example, the floor 342 may temporarily deflect upward toward the polishing head 310 in response to downward vertical movement of the polishing head assembly 300 causing the cap 340 to contact a wafer (such as wafer W shown in FIG. 1). The inside surface 352 of the annular wall 350 at the top portion 356 may be angled with respect to the outside surface 354, such that the thickness of the top portion 356 is thickest at the top edge 360 and tapers downward toward the bottom portion 358.

At least a portion of the outside surface 354 abuts the inner surface 322 of the annular member 320 when the cap 340 is secured to the polishing head 310. Suitably, the outside surface 354 is substantially parallel to the inner surface 322. In this embodiment, the height of the annular wall 350 is greater than the downward extension of the annular member 320 and the inner surface 322 of the annular member 320 circumscribes the top portion 356 of the annular wall 350. In other embodiments, the annular member 320 may circumscribe more or less of the annular wall 350.

The floor 342 is spaced from the recessed surface 326 when the cap 340 is secured to the polishing head 310. As such, the annular wall 350, the top surface 344 of the floor 342, and the recessed surface 326 define a chamber 305 when the cap 340 is secured to the polishing head 310. Because the top edge 360 contacts the recessed surface 326 when the annular wall 350 is secured to the recessed surface 326, the height of the chamber 305 is determined by the height of the annular wall 350. In some embodiments, the chamber 305 is pressurized with a pressurized media or fluid. The chamber 305 may be connected with a pressurized source (not shown) to provide a pressurized media or fluid to the chamber 305. As discussed above, the floor 342 may be capable of temporarily deflecting relative to the polishing head 310 without permanently deforming. For example, adjusting pressure in the chamber 305 may cause deflection of the floor 342 to increase or decrease. In embodiments where the o-ring 362 is used, the seal formed between the top edge 360 and the recessed surface 326 may prevent leakage of the pressurized media or fluid from the chamber 305, thereby maintaining a given pressure in the chamber 305.

The polishing head 310 and the cap 340 may be made of a structural material, such as steel, aluminum, ceramic or another suitable material. In some embodiments, the polishing head 310 and the cap 340 are made of cast aluminum (for example, MIC6® Aluminum Cast Plate available from Alcoa.) In other embodiments, the cap 340 may be made of a ceramic, such as alumina, or plastic material. In embodiments that use a plastic material, a polyetherimide (for example, ULTEM™ Resin 1000 available from Saudi Basic Industries Corporation (SABIC)) may be used. A plastic cap 340 is substantially thicker than one made with either metal or ceramic. Caps made with a ceramic material have substantially thinner floors than those made with either metal or plastic.

Metal used in the polishing head assembly 300 has the potential to contaminate a wafer by being a source of metal ions through the polishing chemicals or slurry. To prevent metal from the polishing head 310 from contaminating the slurry and the wafer, the polishing head 310 is coated with epoxy, fluorocarbon, or another suitable, non-metallic material, to create a barrier to provide metal ion protection.

To prevent metal used in the polishing head assembly 300 from contaminating the slurry and wafer, and/or to prevent chemical exposure of the metal from the polishing chemicals or slurry, a portion of the polishing head 310 and/or the cap 340 is circumscribed by the band 370 forming a barrier between the slurry and the polishing head 310 and/or the cap 340. The band 370 may be a non-metallic material. In some embodiments, the band 370 is made of plastic, such as polyetherimide (for example, ULTEM™ Resin 1000 available from Saudi Basic Industries Corporation (SABIC)), polyether ether ketone, polyphenylene sulfide, or polyethylene terephthalate.

In this embodiment, the band 370 circumscribes and may be sealed to the portion of the outer surface 354 of the annular wall 350 not circumscribed by the polishing head 310, and to the tab 348. The band 370 may also be sealed to the annular member 320 at the bottom edge 372. The band 370 may be sealed to the polishing head 310 and/or the cap 340 using an adhesive, such as epoxy glue. To prevent the seal between the band 370 and the polishing head 310 and/or the cap 340 from coming loose due to adhesive failure, the band 370 may be a unitary one-piece band. The unitary one-piece band 370 may also be held in place by interference fit between the band 370 and the tab 348, and between the band 370 and the bottom edge 372, when the cap 340 is secured to the polishing head 310.

In embodiments where the polishing head assembly 300 includes a template comprising a backing film and retaining ring, such as the backing film 110 and the retaining ring 120 shown in FIG. 1, the band 370 may also overlap at least a portion of the template to prevent metal contamination of the slurry or wafer from the polishing head 310 and/or the cap 340, and/or to prevent chemical exposure of the metal from the polishing chemicals or slurry.

Figure 4:
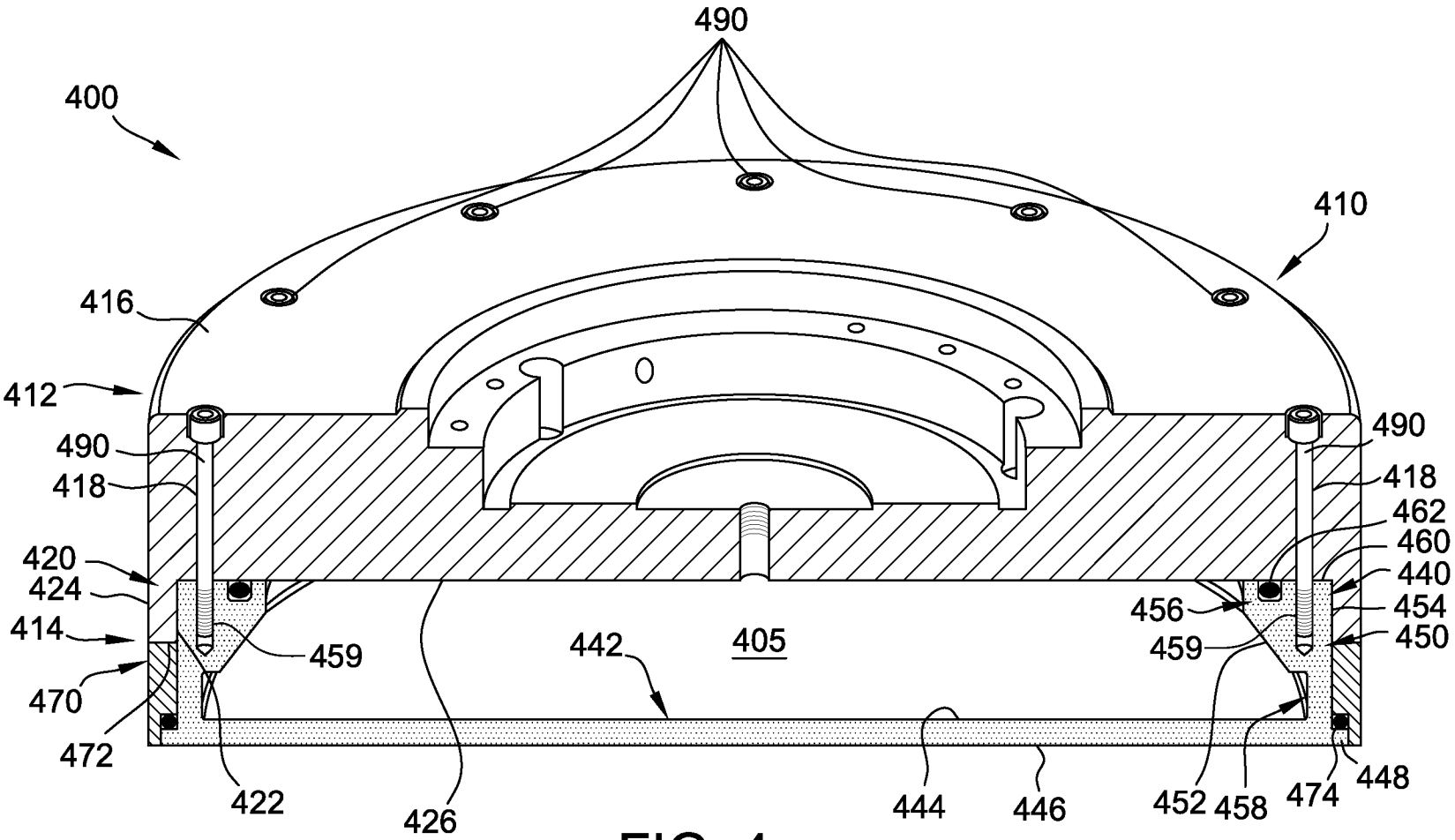
FIG. 4 is a cross section of an example polishing head assembly of a third embodiment.

With reference to FIG. 4, another example polishing head assembly 400 for use in the polishing apparatus 100 is shown. The polishing head assembly 400 includes a polishing head 410, a cap 440, and a band 470. The polishing head assembly 400 may also include a template comprising a backing film and retaining ring, for example, the backing film 110 and the retaining ring 120 (shown in FIG. 1). The polishing head 410 has a top 412 and a bottom 414 that are substantially parallel with each other. The polishing head 410 has a platform 416 at the top 412 and holes 418 extending from the platform 416 through the bottom 414.

The polishing head 410 has an annular member 420 extending downward from the platform 416 to the bottom 414. The annular member 420 has an inner surface 422 and outer surface 424. The outer surface 424 forms the circumference of the polishing head 410. The annular member 420 defines a recess along the bottom 414, and the recess has a recessed surface 426 extending between the annular member 420. The holes 418 extend from the platform 416 through the recessed surface 426 in this embodiment. The annular member 420 has a bottom edge 472 at the bottom 414 which is overlapped by, and may be sealed to, the band 470.

The cap 440 is positioned within the recess defined by the annular member 420. The cap 440 includes a floor 442 surrounded by an annular wall 450 extending upward therefrom. The floor 442 has a top surface 444 and a bottom surface 446. In this embodiment, the bottom surface 446 extends outward past the annular wall 450 to a tab 448. In other embodiments, the bottom surface 446 may not extend past the annular wall 450, such that the annular wall 450 defines the outermost circumference of the cap 440.

The annular wall 450 has an inside surface 452, an outside surface 454, a top portion 456 and a bottom portion 458. The top portion 456 has a top edge 460 and apertures 459 formed at the top edge 460. The apertures 459 extend into the top portion 456 at top edge 460 and correspond to the holes 418. The holes 418 and the corresponding apertures receive fasteners 490 (e.g., screws) to removably secure the annular wall 450 to the recessed surface 426, and thereby removably secure the cap 440 to the polishing head 410. The top edge 460 of the annular wall 450 contacts the recessed surface 426 when the annular wall 450 is secured to the recessed surface 426. The top portion 456 may also include an o-ring 462 at the top edge 460 which forms a seal when the annular wall 450 is secured to the recessed surface 426.

As shown in FIG. 4, the thickness of the annular wall 450 is greater at the top portion 456 than the bottom portion 458. The thinner wall of the bottom portion 458 allows the bottom portion 458 to act as a hinge about which the floor 442 may temporarily deflect without permanently deforming relative to the polishing head 410. For example, the floor 442 may temporarily deflect upward toward the polishing head 410 in response to downward vertical movement of the polishing head assembly 400 causing the cap 440 to contact a wafer (such as wafer W shown in FIG. 1). The inside surface 452 of the annular wall 450 at the top portion 456 may be angled with respect to the outside surface 454, such that the thickness of the top portion 456 is thickest at the top edge 460 and tapers downward toward the bottom portion 458.

At least a portion of the outside surface 454 abuts the inner surface 422 of the annular member 420 when the cap 440 is secured to the polishing head 410. Suitably, the outside surface 454 is substantially parallel to the inner surface 422. In this embodiment, the height of the annular wall 450 is greater than the downward extension of the annular member 420 and the inner surface 422 of the annular member 420 circumscribes the top portion 456 of the annular wall 450. In other embodiments, the annular member 420 may circumscribe more or less of the annular wall 450.

The floor 442 is spaced from the recessed surface 426 when the cap 440 is secured to the polishing head 410. As such, the annular wall 450, the top surface 444 of the floor 442, and the recessed surface 426 define a chamber 405 when the cap 440 is secured to the polishing head 410. Because the top edge 460 contacts the recessed surface 426 when the annular wall 450 is secured to the recessed surface 426, the height of the chamber 405 is determined by the height of the annular wall 450. In some embodiments, the chamber 405 is pressurized with a pressurized media or fluid. The chamber 405 may be connected with a pressurized source (not shown) to provide a pressurized media or fluid to the chamber 405. As discussed above, the floor 442 may be capable of temporarily deflecting relative to the polishing head 410 without permanently deforming. For example, adjusting pressure in the chamber 405 may cause deflection of the floor 442 to increase or decrease. In embodiments where the o-ring 462 is used, the seal formed between the top edge 460 and the recessed surface 426 may prevent leakage of the pressurized media or fluid from the chamber 405, thereby maintaining a given pressure in the chamber 405.

The polishing head 410 and the cap 440 may be made of a structural material, such as steel, aluminum, ceramic or another suitable material. In some embodiments, the polishing head 410 and the cap 440 are made of cast aluminum (for example, MIC6® Aluminum Cast Plate available from Alcoa.) In other embodiments, the cap 440 may be made of a ceramic, such as alumina, or plastic material. In embodiments that use a plastic material, a polyetherimide (for example, ULTEM™ Resin 1000 available from Saudi Basic Industries Corporation (SABIC)) may be used. A plastic cap 440 is substantially thicker than one made with either metal or ceramic. Caps made with a ceramic material have substantially thinner floors than those made with either metal or plastic.

Metal used in the polishing head assembly 400 has the potential to contaminate a wafer by being a source of metal ions through the polishing chemicals or slurry. To prevent metal from the polishing head 410 from contaminating the slurry and the wafer, the polishing head 410 is coated with epoxy, fluorocarbon, or another suitable, non-metallic material, to create a barrier to provide metal ion protection.

To prevent metal used in the polishing head assembly 400 from contaminating the slurry and wafer, and/or to prevent chemical exposure of the metal from the polishing chemicals or slurry, a portion of the polishing head 410 and/or the cap 440 is circumscribed by the band 470 forming a barrier between the slurry and the polishing head 410 and/or the cap 440. The band 470 may be a non-metallic material. In some embodiments, the band 470 is made of plastic, such as polyetherimide (for example, ULTEM™ Resin 1000 available from Saudi Basic Industries Corporation (SABIC)), polyether ether ketone, polyphenylene sulfide, or polyethylene terephthalate.

In this embodiment, the band 470 circumscribes and may be sealed to the portion of the outer surface 454 of the annular wall 450 not circumscribed by the polishing head 410, and to the tab 448. The band 470 may also be sealed to the annular member 420 at the bottom edge 472. The band 470 may be secured to the polishing head 410 and/or the cap 440 using an adhesive, such as epoxy glue. To prevent the seal between the band 470 and the polishing head assembly 400 from coming loose due to adhesive failure, the band 470 may be a unitary one-piece band. The unitary one-piece band 470 may also be held in place by interference fit between the band 470 and the tab 448, and between the band 470 and the bottom edge 472, when the cap 440 is secured to the polishing head 410. In this embodiment, tab 448 has an o-ring 474 which forms a seal between the tab 448 and the band 470. The o-ring 474 may add an additional seal to prevent chemical exposure inside the joint between the band 470 and the polishing head assembly 400. The o-ring 474 may also compensate for possible undesirable clearance due to tolerance stack.

In embodiments where the polishing head assembly 400 includes a template comprising a backing film and retaining ring, such as the backing film 110 and the retaining ring 120 shown in FIG. 1, the band 470 may also overlap at least a portion of the template to prevent metal contamination of the slurry or wafer from the polishing head 410 and/or the cap 440, and/or to prevent chemical exposure of the metal from the polishing chemicals or slurry.

Features of the above-described embodiments have several advantages. For example, by attaching the polishing head assembly using fasteners in place of epoxy, problems associated with epoxy joint failure, which is a main cause of failure during the service life of the polishing head assembly, can be reduced or eliminated. When the polishing head assembly does need repair, the fasteners allow for disassembly of the polishing head assembly without the use of heat or other destructive action to reduce maintenance time which may help salvage parts. Reassembly of the polishing head assembly may take place without applying a new material coat to the polishing head assembly, if coating is used. An indexing pin may be used to ensure the parts are put together in the original orientation which may avoid the need for repeated lapping of parts. The indexing pin may therefore prevent flatness issues associated with reassembly of conventional polishing head assemblies using fasteners (e.g., screws). Additionally, by securing a top edge of the annular wall of the cap to the recessed surface of the polishing head, leakage of pressurized media or fluid from the chamber of the polishing head assembly can be prevented. This seal may further be improved by using an o-ring at this connection. Also, the non-metallic band prevents contact between the polishing chemicals or slurry and the polishing head assembly, maintaining the service life of the polishing head and cap.

Figure 5:
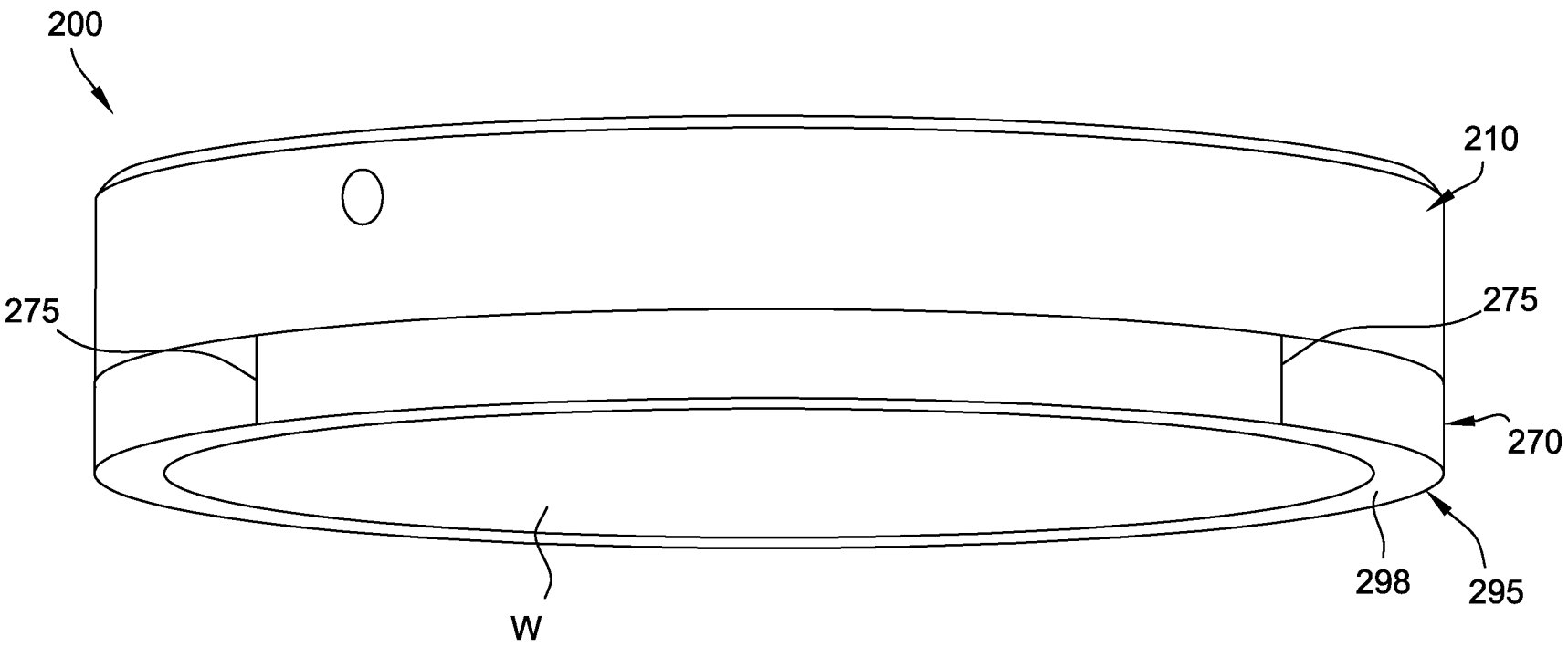
FIG. 5 is a perspective view of the polishing head assembly shown in FIG. 2 including a template and a wafer retained by the template.
Figure 6:
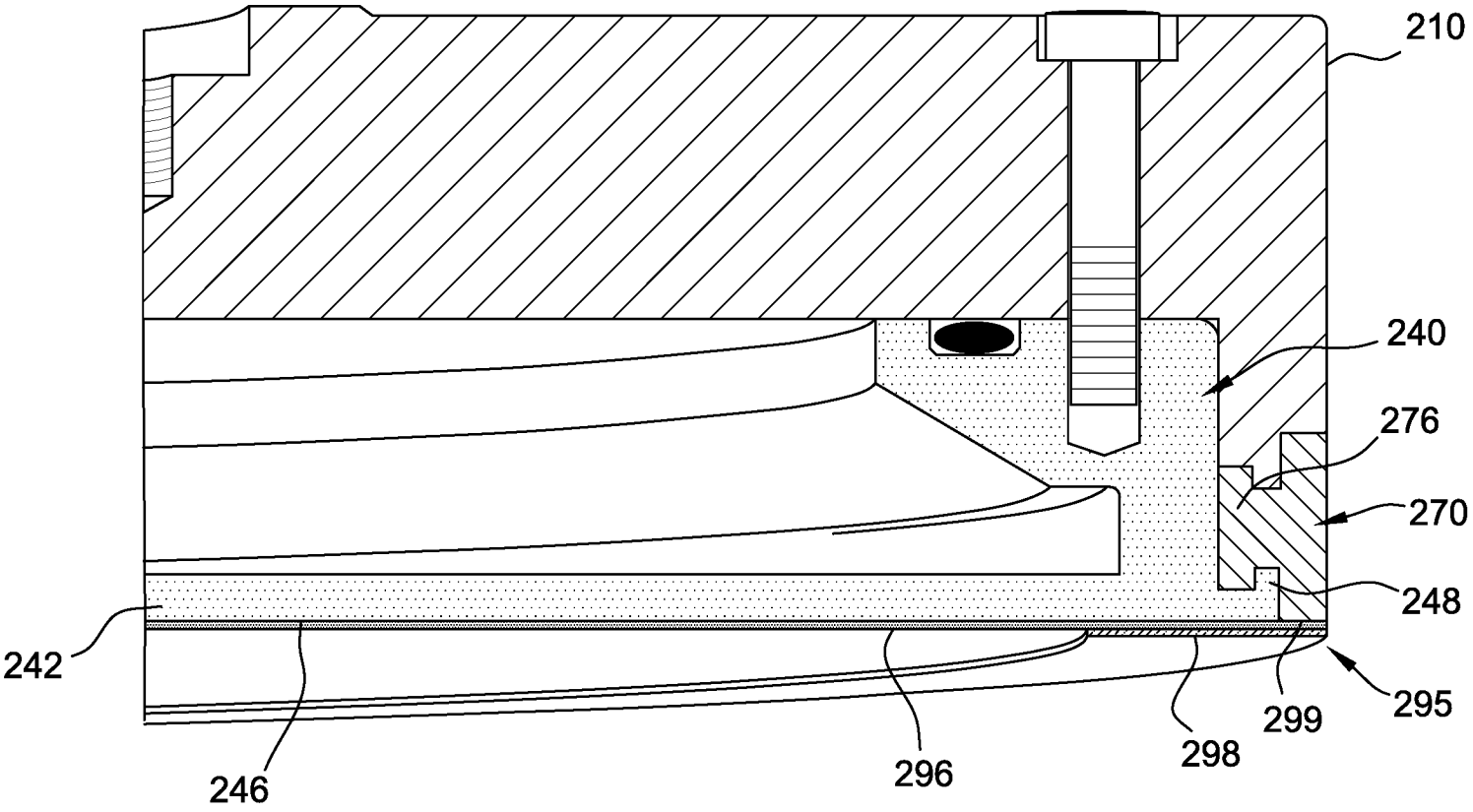
FIG. 6 is a partial cross section of the polishing head assembly shown in FIG. 5, without the wafer.

With reference to FIGS. 5 and 6, a perspective view and a partial cross section, respectively, of the polishing head assembly 200 of FIG. 2 are shown. As discussed above, the polishing head assembly 200 includes polishing head 210, cap 240, and band 270. The cap 240 has the floor 242, which has the bottom surface 246 extending outward to the tab 248. As shown in FIGS. 5 and 6, the polishing head assembly 200 also includes a template 295. The template 295 includes a backing film 296 and a retaining ring 298. The retaining ring 298 extends downward along the perimeter of the backing film 296 to form a circular opening that receives a wafer W (shown in FIG. 5). In some embodiments, a height of the retaining ring 298 is less than a height of the wafer W, which facilitates reducing or eliminating the contact of retaining ring 298 with a polishing pad, such as the polishing pad 150 (shown in FIG. 1), during operation. The wafer W of this embodiment is retained against backing film 296 by surface tension.

To prevent metal used in the cap 240 from contaminating the slurry and the wafer W, the backing film 296 of the template 295 is sealed to the bottom surface 246 of the cap 240 using a pressure sensitive adhesive. The backing film 296 is generally a thin soft polymer pad or other suitable material. The backing film 296 suitably includes two or more layers of material (not shown). For example, backing film 296 may have an adhesive layer, a thin plastic film layer, and a thin polyurethane foam, or other non-woven material (e.g., felt), layer. The adhesive layer seals the backing film 296 to the bottom surface 246 of the cap 240. The thin plastic film layer provides a protective barrier between the cap 240 and the slurry and/or the wafer W. The layer comprising polyurethane foam or non-woven material (e.g., felt) contacts the wafer W and provides a surface similar to that of a polishing pad (such as the polishing pad 150 shown in FIG. 1). The retaining ring 298 extends downward from the backing film 296 and is generally a plastic material. The wafer W is received by the retaining ring 298 and is retained against the backing film 296 by surface tension. As such, the wafer W does not directly contact the cap 240.

In this embodiment, the template 295 has a circumference greater than the circumference of the cap 240 and extends outward from the tab 248. The cap 240 is circumscribed by the band 270, which overlaps an outer portion of the template 295 at overlap surface 299. The backing film 296 of the template 295 is sealed to the bottom surface 246, and to the band 270 at overlap surface 299, using a pressure sensitive adhesive. Together, the band 270 and the template 295 form a protective seal between the slurry and the wafer W and the polishing head 210 and the cap 240 to prevent the slurry and the wafer W from directly contacting the polishing head 210 and the cap 240.

The embodiments described herein provide the ability to disassemble a polishing head assembly without the use of heat or other destructive action and enable an efficient and economical repair of the polishing head assembly. The embodiments described herein also provide the ability to attach a polishing head assembly using fasteners, while maintaining the desired flatness and other specifications of a polished wafer.

Another advantage of using the embodiments described herein is problems associated with epoxy joint failure during the service life of the polishing head assembly can be reduced or eliminated. Additionally, air leaks from the pressurized chamber are prevented by the seal formed between the cap and the recessed surface. The band and template provide further protection of the wafer and the metal of the polishing head assembly, and may reduce the amount of epoxy required for attaching the polishing head assembly and/or the chance of epoxy joint failure due to chemical exposure.

When introducing elements of the present disclosure or the embodiment(s) thereof, the articles "a", "an", "the" and "said" are intended to mean that there are one or more of the elements. The terms "comprising", "including" and "having" are intended to be inclusive and mean that there may be additional elements other than the listed elements. The use of terms indicating a particular orientation (e.g., "top", "bottom", "side", "down", "up", etc.) is for convenience of description and does not require any particular orientation of the item described.

As various changes could be made in the above constructions and methods without departing from the scope of the disclosure, it is intended that all matter contained in the above description and shown in the accompanying drawing[s] shall be interpreted as illustrative and not in a limiting sense.

What is claimed is:

1. A polishing head assembly for polishing of semiconductor wafers, the polishing head assembly comprising:

a polishing head having a top portion and a downwardly extending annular member defining a recess along a bottom portion, the recess having a recessed surface, and holes extending from the top portion through the recessed surface;

a cap positioned within the recess, the cap having an annular wall and a floor extending across the annular wall, the floor having a bottom surface and a top surface and being spaced from the recessed surface to form a chamber between the recessed surface and the top surface, wherein the annular wall has apertures corresponding to the holes, and wherein the cap is made of a metallic material; and a band circumscribing a first portion of the annular wall, wherein the band is made of a non-metallic material;

wherein the annular member circumscribes a second portion of the annular wall;

wherein the thickness of the annular wall in a radial direction is greater at a top portion than at a bottom portion; and wherein the holes and the corresponding apertures receive fasteners to removably secure the annular wall of the cap to the recessed surface of the polishing head.

2. The polishing head assembly of claim 1, wherein the band is non-unitary having at least two segments.

3. The polishing head assembly of claim 2, wherein the band has an interlocking member to secure the band to the annular wall.

4. The polishing head assembly of claim 1, wherein the band is a unitary one-piece band.

5. The polishing head assembly of claim 1, wherein the band is made of the non-metallic material is selected from the group consisting of polyetherimide, polyether ether ketone, polyphenylene sulfide, and polyethylene terephthalate.

6. The polishing head assembly of claim 1, wherein the annular wall has a top edge that contacts the recessed surface when the annular wall and the recessed surface are secured.

7. The polishing head assembly of claim 6, wherein the top edge comprises an o-ring forming a seal when the annular wall and the recessed surface are secured.

8. The polishing head assembly of claim 1, further comprising a template attached to the bottom surface of the floor, the template comprising a backing film.

9. The polishing head assembly of claim 8, wherein the template is attached to the bottom surface using a pressure sensitive adhesive.

10. The polishing head assembly of claim 8, wherein the template extends outward past an outer surface of the annular wall such that the band overlaps a portion of the template.

11. The polishing head assembly of claim 10, wherein a pressure sensitive adhesive forms a seal at the portion of the template overlapped by the band.

12. The polishing head assembly of claim 8, wherein the template further comprises a retaining ring extending downward from the backing film.

13. The polishing head assembly of claim 12, wherein the retaining ring forms an opening to receive a semiconductor wafer, and wherein a height of the wafer is greater than a height of the retaining ring.

14. The polishing head assembly of claim 13, wherein the template is used with a liquid to retain the wafer on the polishing head assembly by surface tension.

15. A polishing head assembly for polishing of semiconductor wafers, the polishing head assembly comprising:

a polishing head having a top portion and a downwardly extending annular member defining a recess along a bottom portion, the recess having a recessed surface, and holes extending from the top portion through the recessed surface;

a cap positioned within the recess, the cap having an annular wall extending between and upper surface and a floor extending across the annular wall, the floor being spaced from the recessed surface to form a chamber therebetween, wherein the annular wall has a first portion and a second portion, the first portion having apertures corresponding to the holes, the second portion extending downward from the first portion, and wherein the cap is made of a metallic material, wherein the thickness of the annular wall adjacent the upper surface is greater than a thickness of the annular wall adjacent the floor; and a unitary one-piece band circumscribing the second portion of the annular wall, wherein the band is made of a non-metallic material;

wherein the annular member circumscribes a second portion of the annular wall;

wherein the holes and the corresponding apertures receive fasteners to removably secure the first portion of the annular wall of the cap to the recessed surface of the polishing head; and wherein the first portion of the annular wall has a first o-ring forming a seal when the first portion and the recessed surface are secured.

16. The polishing head assembly of claim 15, wherein the cap has a tab extending outward from the second portion of the annular wall, and a second o-ring forming a seal between the tab and the band.

17. The polishing head assembly of claim 15, wherein the band is made of a non-metallic material selected from the group consisting of polyetherimide, polyether ether ketone, polyphenylene sulfide, and polyethylene terephthalate.

* * * * *